US010016982B2

(12) United States Patent
Kuronuma et al.

(10) Patent No.: US 10,016,982 B2
(45) Date of Patent: Jul. 10, 2018

(54) INKJET APPARATUS

(71) Applicant: CANON KABUSHIKI KAISHA, Tokyo (JP)

(72) Inventors: Daigo Kuronuma, Kawasaki (JP); Tomoyuki Nagase, Yokohama (JP); Tomohito Abe, Yokohama (JP); Hiroshi Arimizu, Kawasaki (JP); Yusuke Imahashi, Kawasaki (JP); Nobuhito Yamaguchi, Inagi (JP); Yoshihiro Koyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/269,696

(22) Filed: Sep. 19, 2016

(65) Prior Publication Data

US 2017/0087862 A1 Mar. 30, 2017

(30) Foreign Application Priority Data

Sep. 26, 2015 (JP) ..... 2015-189036

(51) Int. Cl.

| | |
|---|---|
| ***B41J 2/175*** | (2006.01) |
| ***B41J 2/17*** | (2006.01) |
| ***B41J 29/02*** | (2006.01) |
| ***B41J 11/00*** | (2006.01) |

(52) U.S. Cl.

CPC ..... *B41J 2/17546* (2013.01); *B41J 2/1714* (2013.01); *B41J 11/0095* (2013.01); *B41J 29/02* (2013.01)

(58) Field of Classification Search

CPC ..... B41J 2/17503; B41J 2/17506; B41J 2/17509; B41J 2/17513; B41J 2/1752; B41J 2/17523; B41J 2/17526; B41J 2/1753; B41J 2/17533; B41J 2/17536; B41J 2/1754; B41J 2/17543; B41J 2/17553; B41J 2/17546; B41J 2/1755; B41J 11/0095; B41J 29/02; B41J 2/1714

See application file for complete search history.

(56) References Cited

U.S. PATENT DOCUMENTS 6,561,620 B2 * 5/2003 Pietrzyk ..... B41J 2/2132 347/34
7,578,572 B2 * 8/2009 Naruse ..... B41J 2/165 347/29

FOREIGN PATENT DOCUMENTS

JP 2002-361858 A 12/2002
JP 2007-62222 A 3/2007

* cited by examiner

*Primary Examiner* — Kristal Feggins
(74) *Attorney, Agent, or Firm* — Canon USA, Inc. I.P. Division

(57) ABSTRACT

An inkjet apparatus includes, a carriage, mounting a head that discharges ink, configured to reciprocally move with respect to a sheet that receives the ink, a sensor unit, attached to the carriage, configured to read information from the sheet, and a rectifying skirt, attached to the carriage, having a rectifying surface that faces the sheet. The sensor unit is disposed above the rectifying skirt.

10 Claims, 9 Drawing Sheets

INKJET APPARATUS

BACKGROUND OF THE INVENTION

Field of the Invention

Aspects of the present invention relate to an inkjet apparatus in which a sensor unit is mounted on a carriage.

Description of the Related Art

A serial inkjet printing apparatus is discussed in Japanese Patent Application Laid-Open No. 2002-361858 and Japanese Patent Application Laid-Open No. 2007-62222. A serial printing apparatus forms an image by repeating an operation for discharging ink from a head while moving a carriage and an operation for step-feeding a sheet.

In such a serial printing apparatus, when the carriage moves, turbulence occurs around the print head and between the print head and the sheet possibly disturbing the ink landing position. Japanese Patent Application Laid-Open No. 2002-361858 discusses a configuration in which a rectifying skirt is provided at a lower portion of a carriage to rectify turbulence to prevent degradation of image quality. On the other hand, Japanese Patent Application Laid-Open No. 2007-62222 discusses a configuration in which a sensor unit is attached to a side of a carriage to optically detect sheet information.

Simply combining Japanese Patent Application Laid-Open No. 2002-361858 and Japanese Patent Application Laid-Open No. 2007-62222 provides an embodiment in which a sensor unit is supported outside a carriage and a rectifying skirt is supported outside the sensor unit. In this case, a level difference or gap occurs at a connecting portion of the carriage and the sensor unit. Therefore, even if a rectifying skirt is provided, turbulence occurs at such a level difference or gap making it impossible to obtain sufficient rectification effects.

When the inkjet head discharges ink, unintended ink mist occurs. In an embodiment in which a rectifying skirt is provided, much ink mist adheres to the undersurface of the rectifying skirt which therefore is likely to become stained. If the rectifying skirt is stained to a further extent, mist may liquefy possibly dropping to a sheet or platen. In addition, ink mist is likely to adhere to components of the sensor unit, such as a light emitting element and a relight receiving element. This mist stain may cause degradation of the detection accuracy of the sensor.

SUMMARY OF THE INVENTION

Aspects of the present invention are directed to achieving a practical apparatus in which both a rectifying skirt and a sensor unit are mounted on a carriage. Aspects of the present invention are further directed to improving rectification effects by the rectifying skirt provided below the carriage to a further extent than in conventional apparatuses. Aspects of the present invention are still further directed to more effectively restricting adhesion of ink mist to components of the sensor unit mounted on the carriage than in conventional apparatuses.

According to an aspect of the present invention, an inkjet apparatus includes, a carriage, mounting a head that discharges ink, configured to reciprocally move with respect to a sheet that receives the ink, a sensor unit, attached to the carriage, configured to read information from the sheet, and a rectifying skirt, attached to the carriage, having a rectifying surface that faces the sheet. The sensor unit is disposed above the rectifying skirt.

Further aspects of the present invention will become apparent from the following description of exemplary embodiments with reference to the attached drawings.

DESCRIPTION OF THE EMBODIMENTS

A two-dimensional or three-dimensional inkjet printing apparatus according to exemplary embodiments of the present invention will be described below. Aspects of the present invention are applicable not only to printing apparatuses but also to various types of inkjet apparatuses (liquid discharge apparatuses) which perform manufacture, processing, and treatment of a target product by using liquid discharged from a liquid discharge head mounted on a carriage.

Figure 1:
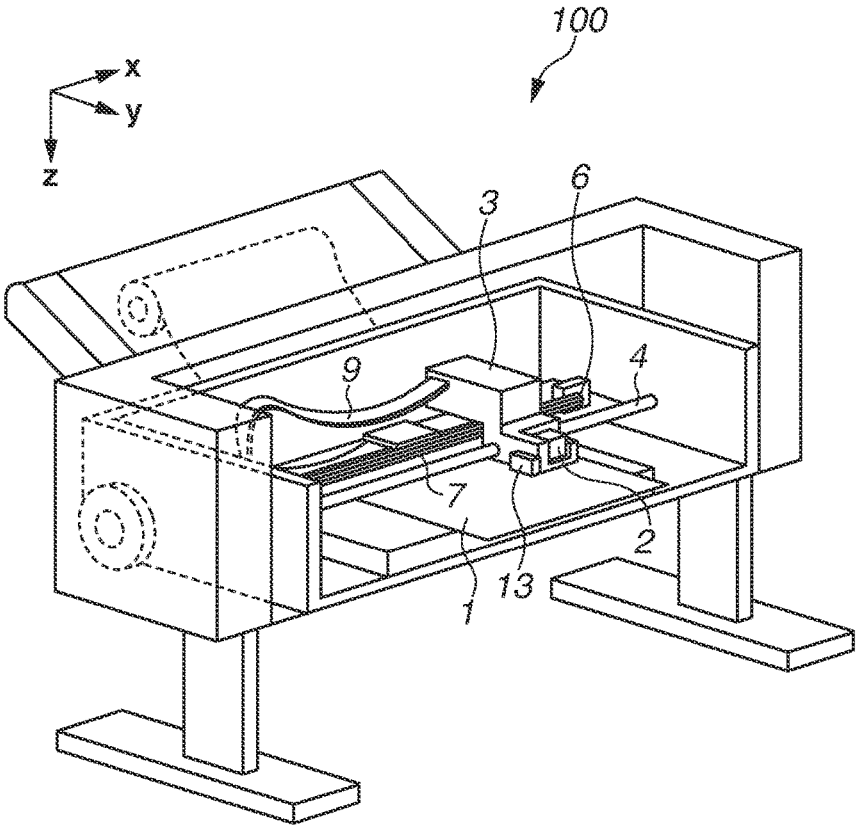
FIG. 1 is a perspective view illustrating an entire configuration of an inkjet apparatus.

FIG. 1 is a perspective view illustrating an entire configuration of a printing apparatus 100. The printing apparatus 100 includes an inkjet print head 2, a carriage 3, a guide shaft 4, a timing belt 7, a flexible cable 9, an ink tube 18, an ink tank (not illustrated), a platen 25, and a sensor unit 13. The printing apparatus 100 is an inkjet apparatus employing a serial printing method.

The print head 2 is provided with a plurality of nozzles, and the ink discharged from the nozzle in the Z direction (discharge direction) indicated by the arrow is applied to the surface of a sheet 1. As an energy generation element for discharging ink, any types of elements such as a heating element, a piezoelectric element, an electrostatic element, and a Micro Electro Mechanical Systems (MEMS) element may be used.

A carriage 3 is slidably supported by a guide shaft 4. The reciprocal movement of the carriage 3 is guided in the X direction (main scanning direction) along the plane of the sheet 1. The carriage 3 becomes movable when a driving force transfer mechanism such as a timing belt 7 transmits a driving force from a carriage motor to the carriage 3. A pulley connected to the carriage motor is disposed at one end of the movable range of the carriage 3, and an idle pulley 6 is disposed at the other end thereof. The timing belt 7 is stretched between the pulley and the idle pulley 6, and the carriage 3 is connected with the timing belt 7. To prevent the carriage 3 from rotating centering on the guide shaft 4, the printing apparatus 100 is provided with a support member extending in parallel with the guide shaft 4. The carriage 3 is slidably supported by this support member.

The print head 2 is detachably attached onto the carriage 3. Ink is stored in the inside of an ink tank (not illustrated)

mounted on the printing apparatus 100. The ink is supplied to the print head 2 via ink tubes 18 laid around in the printing apparatus 100 and on the carriage 3. The ink tubes 18 are divided into two routes, i.e., they are laid along the right- and left-hand side surfaces of the carriage 3. These two routes of the ink tubes 18 are connected to the print head 2 via a common tube joint 19. When attaching or detaching the print head 2, the tube joint 19 connects to or separates from the print head 2. Although, in cases to be described below, the print head 2 and the ink tank are separately configured, the print head 2 and the ink tank may be integrally formed as an ink cartridge and mounted on the carriage 3.

The carriage 3 mounts an optical sensor unit 13. The sensor unit 13, a multi-sensor having a plurality of measurement functions, optically acquires information from the sheet 1. The sensor unit 13 includes optical members (sensor components) such as a light emitting element 22 and a light receiving element 23 (described below).

The carriage 3 is connected with an electric substrate configuring a control unit of the printing apparatus 100 via the flexible cable 9. This controls ink discharge from each nozzle of the print head 2 and the measurement by the sensor unit 13.

A sheet 1 subjected to ink application is conveyed on a platen 25 in the subscanning direction (the direction indicated by the arrow Y) intersecting with the main scanning direction (the direction indicated by arrow X) by a conveyance motor. During the print operation, the print head 2 performs a print operation on the sheet 1 conveyed to a predetermined position by a conveyance roller. With the movement of the carriage 3 in the X direction, the print head 2 mounted on the carriage 3 discharges ink toward the sheet 1 at a suitable timing according to print data. When this print scan is completed, the sheet 1 is conveyed by a predetermined amount in the Y direction, and then the next print scan is performed. The serial print method alternately repeats a print scan operation and a sheet step-feed operation in this way to form an image or a three-dimensional object on the sheet 1.

Figure 2:
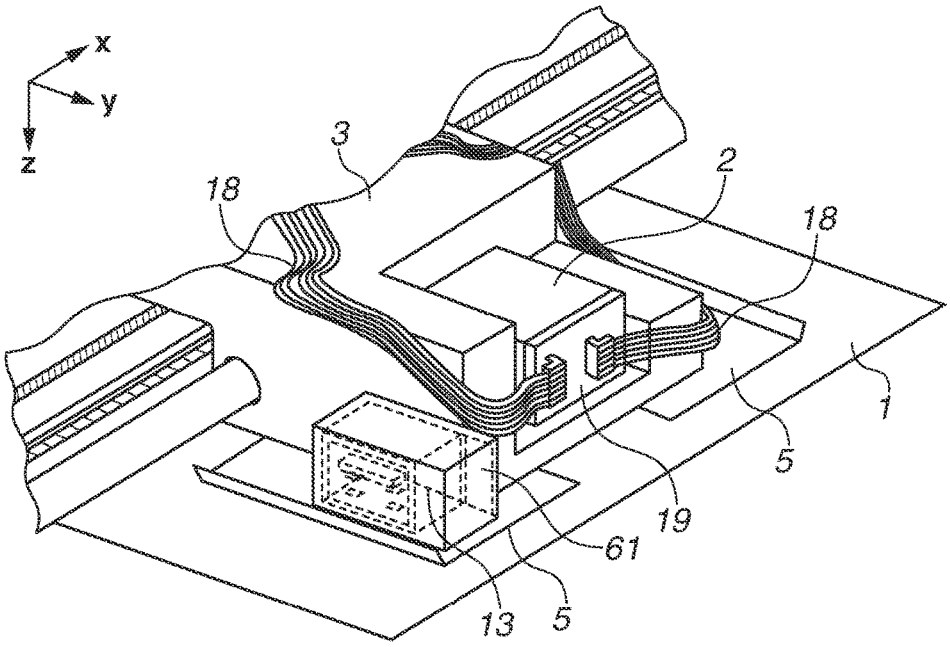
FIG. 2 is an enlarged perspective view illustrating a configuration of a periphery of a carriage.

FIG. 2 is an enlarged perspective view illustrating a configuration of the periphery of the carriage 3 illustrated in FIG. 1. The print head 2 and the sensor unit 13 are mounted on the carriage 3. The sensor unit 13 is attached to the right- and left-hand side surfaces of the carriage 3 which are the leading and the trailing ends in the moving direction of the carriage 3 (X direction). The sensor unit 13 moves with the movement of the carriage 3. The sensor unit 13 is used to measure the density of a patch printed on the sheet 1, detect an edge position of the sheet 1, and detect a pattern printed on the sheet 1. During the print operation and non-print operation, the sensor unit 13 can perform sensing.

The sensor unit 13 is provided with an air inlet 61 which is an opening for taking air while the carriage 3 is running. Two rectifying skirts 5 (rectifying members) are attached below the carriage 3. The rectifying skirts 5 will be described in more detail below with reference to FIGS. 3A, 3B, and 4.

Figure 3A:
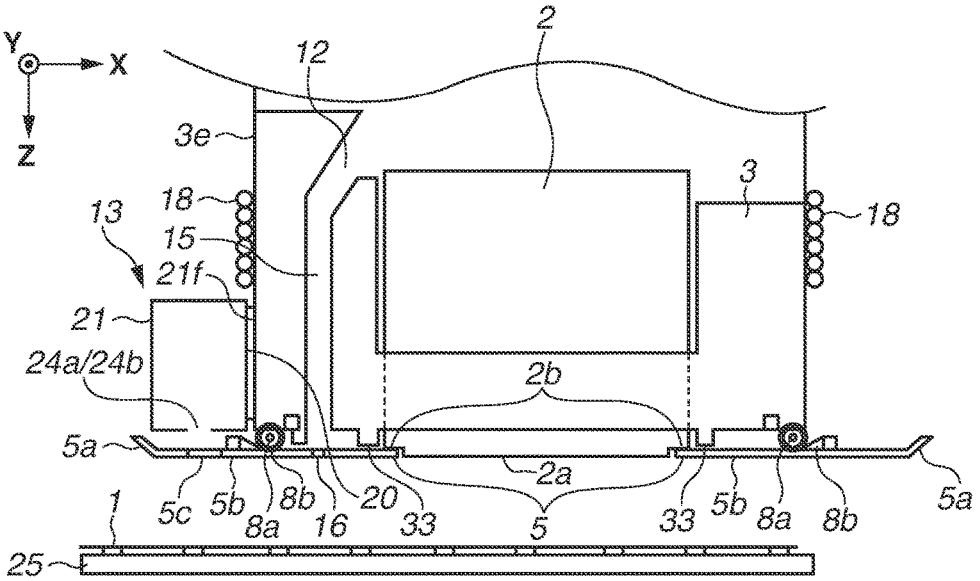
FIGS. 3A and 3B are front sectional views illustrating the carriage.
Figure 3B:
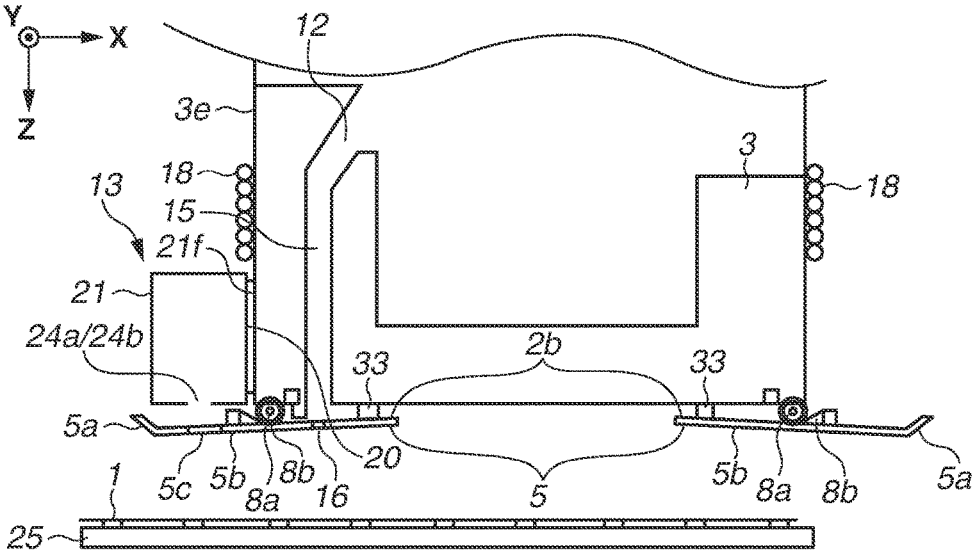
Figure 4:
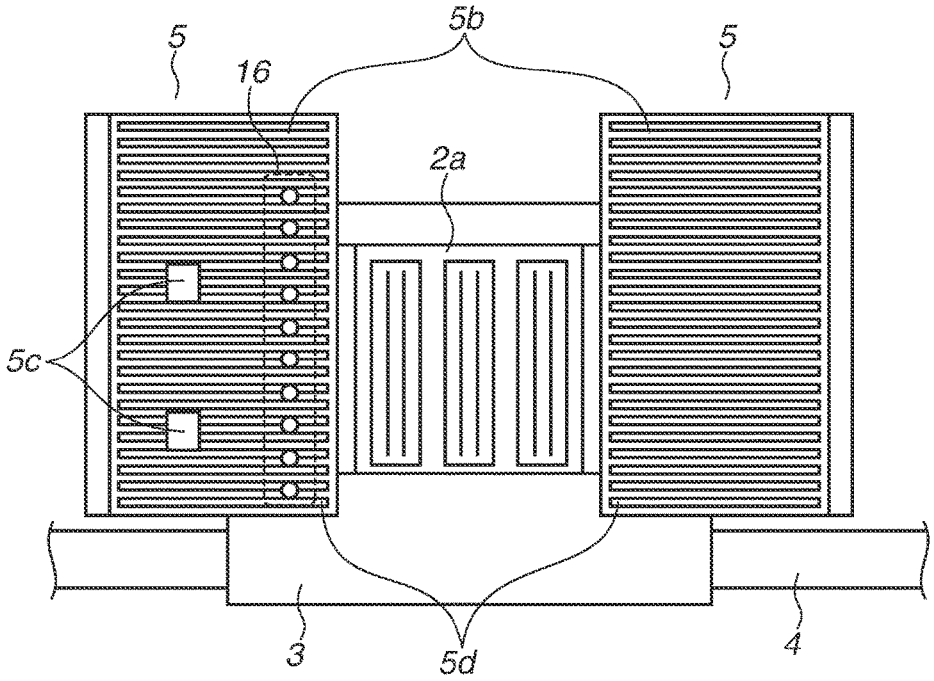
FIG. 4 is a bottom view illustrating the carriage.

FIGS. 3A and 3B are front sectional views illustrating the carriage 3 when viewed from the front (Y direction). FIG. 3A illustrates a state where the print head 2 is mounted, and FIG. 3B illustrates a state where the print head 2 is not mounted. FIG. 4 is a bottom view illustrating the carriage 3 when viewed from the bottom (Z direction).

While the carriage 3 is moving, the rectifying skirts 5 restrain turbulence occurring between the print head 2 and the sheet 1 to reduce deviated landing of ink drops by turbulence. The two rectifying skirts 5 are supported on the undersurface of the carriage 3 so as to sandwich the nozzle of the print head 2 from both sides in the X direction.

Each rectifying skirt 5 is provided with an even rectifying surface 5*b* at the bottom. The inner side end of the rectifying skirt 5 contacts an abutting portion 2*b* in the vicinity of a nozzle surface 2*a* of the print head 2. The rectifying surface 5*b* extends in the X direction from under the abutting portion 2*b* to the outside of the carriage 3. The rectifying skirt 5 on the side of the sensor unit 13, out of the two rectifying skirts 5, covers the bottom of the sensor unit 13 and further extends to the outside range thereof. The outermost end (the end most away from the print head 2) of the rectifying skirt 5 in the X direction is a slanted portion 5*a* upwardly bent (in the direction away from the sheet 1). This bending is made to make it hard that the carriage 3 catches the floating sheet 1 while the carriage 3 is running.

With this configuration, all of connecting portions of parts are covered by the rectifying skirt 5, and the rectifying surface 5*b* is formed as a continuous surface extending from the vicinity of the nozzle surface 2*a* to the outside of the carriage 3. In particular, although large gaps and level differences between the carriage 3 and the sensor unit 13 are likely to cause turbulence, the rectifying surface 5*b* covers these portions to achieve effective rectification.

However, since the rectifying skirt 5 exists under the sensor unit 13, the rectifying skirt 5 is provided with small openings 5*c* as through holes for sensing at two different portions through which the optical axes of the light emitting element 22 and the light receiving element 23 passes, so that the sensing is not prevented from being performed (refer to FIG. 4).

It is desirable to reduce the level difference in the Z direction as much as possible between the rectifying surface 5*b* of the rectifying skirt 5 and the nozzle surface 2*a* of the print head 2. Therefore, the inner side end of the rectifying skirt 5 is made contact a part (abutting portion) of the print head 2 to position the rectifying skirt 5 in the Z direction with reference to the print head 2. Specifically, the rectifying skirt 5 is rotatably attached to the bottom of the carriage 3 within a small angular range centering on a rotational shaft 8*a*. This rotation allows the rectifying skirt 5 to slightly change its orientation. The bottom of the print head 2 is provided with the abutting portions 2*b* as cut edge portions. As illustrated in FIG. 3A, when the print head 2 is attached to the carriage 3, the abutting portion 2*b* contacts the end of the rectifying skirt 5 to depress and rotate the rectifying skirt 5, and the rectifying surface 5*b* is fixed to a horizontal orientation parallel to the platen 25 (sheet 1). To provide a biasing force for abutting the rectifying skirt 5 against the print head 2, the rotational shaft 8*a* is provided with a torsion coil spring 8*b*. This biasing force maintains a state where the end of the rectifying skirt 5 and the abutting portion 2*b* of the print head 2 are constantly in close contact with each other even while the carriage 3 is running.

In a state where the print head 2 is attached in this way as illustrated in FIG. 3A, the nozzle surface 2*a* of the print head 2 and the rectifying surface 5*b* are maintained at an approximately the same height (with an approximately the same distance to the sheet 1). Therefore, the nozzle surface 2*a* and the two rectifying surfaces 5*b* which sandwich the nozzle surface 2*a* from both sides can be substantially considered as one plane. Therefore, the entire bottom of the carriage 3 forms a flat plane, effectively restricting the occurrence of turbulence.

As illustrated in FIG. 3B, in a state where the print head 2 is not mounted on the carriage 3, the biasing force of the torsion coil spring 8*b* makes the rectifying skirt 5 contact a regulating portion 33 serving as a projection formed on the bottom of the carriage 3, restricting the further rotation (orientation change) of the rectifying skirt 5. In a state where the print head 2 is not mounted on the carriage 3 (for example, during transportation of the printing apparatus shipped from the factory), the rectifying skirt 5 is prevented from contacting and damaging the platen 25 even if a large impact is applied to the printing apparatus.

To change a print gap (distance between the nozzle surface 2*a* and the sheet 1), the carriage 3 is provided with a mechanism for moving in the height direction (Z direction) with respect to the platen 25. In this example, the adjustable range of the print gap is 1 to 3 mm. It is demanded that, even with the minimum print gap (1 mm), the lowermost portion (boundary between the slanted portion 5*a* and the rectifying surface 5*b*) of the rectifying skirt 5 does not contact the platen 25. To achieve a rotation range of the rectifying skirt 5 which satisfies this condition, the position of the regulating portion 33, the height of the projection, and the dimensional relation between the rotational shaft 8*a* and the rectifying skirt 5 are determined. Specifically, with the minimum print gap, the rectifying skirt 5 does not contact the surface of the platen 25 even if the orientation of the rectifying skirt 5 changes.

The rectifying skirts 5 will be described in more detail below. When the print head 2 discharges ink, ink mist occurs. Since the rectifying skirts 5 rectify air containing a large amount of ink mist immediately after ink mist occurs, a large amount of ink mist adheres to the rectifying surfaces 5*b*. If printing is continuously performed for a prolonged period of time, a large amount of ink mist adhering to the rectifying surfaces 5*b* may become liquid and drop to the sheet 1 or the platen 25, possibly soiling a printed product. The rectifying surfaces 5*b* of the rectifying skirts 5 are likely to be soiled by much ink mist adhering thereto in this way. If the soiling of the rectifying surfaces 5*b* further progresses, ink mist becomes liquid and drop, which may cause a printing failure. In addition, ink mist is likely to adhere to the components of the sensor unit 13, for example, the light emitting element 22 and the light receiving element 23. This soiling may cause the degradation of the detection accuracy of the sensor.

To cope with this problem, as illustrated in FIG. 4, a number of minute grooves 5*d* are formed on the rectifying surfaces 5*b* at equal arrangement pitches. This increases the substantial surface area of the rectifying surfaces 5*b*. In this case, even if ink mist becomes liquid on the rectifying surfaces 5*b*, the liquid spreads along the grooves 5*d* and is retained by the large surface tension of the surface area, making ink droplets hard to drop.

The grooves 5*d* are arranged so as to extend in the direction intersecting with the nozzle array for discharging ink. In this example, nozzles are arranged so that the moving direction of the carriage 3 (X direction) becomes the longitudinal direction thereof to match the direction of air current relatively with the direction of the grooves 5*d*. This reduces the probability that level differences of the grooves 5*d* disturb the air current. Even if the sheet 1 floats and contacts either rectifying skirt 5, the grooves 5*d* formed in parallel with the moving direction of the carriage 3 reduce the possibility that the carriage 3 catches the sheet 1, restricting damage to the sheet 1. To make the above-described actions and effects, the grooves 5*d* are arranged at arrangement pitches (adjacent grooves are arranged at distances) of 5 mm or less, more preferably, 1 mm or less.

A plurality of the grooves 5*d* formed on the rectifying surface 5*b* provides a high rectification effect in this way. In addition, even if ink mist adhering to the rectifying surface 5*b* becomes liquid, the liquid spreads along the grooves 5*d* and is retained by the large surface tension, making ink droplets hard to drop from the rectifying surface 5*b*.

Figure 5:
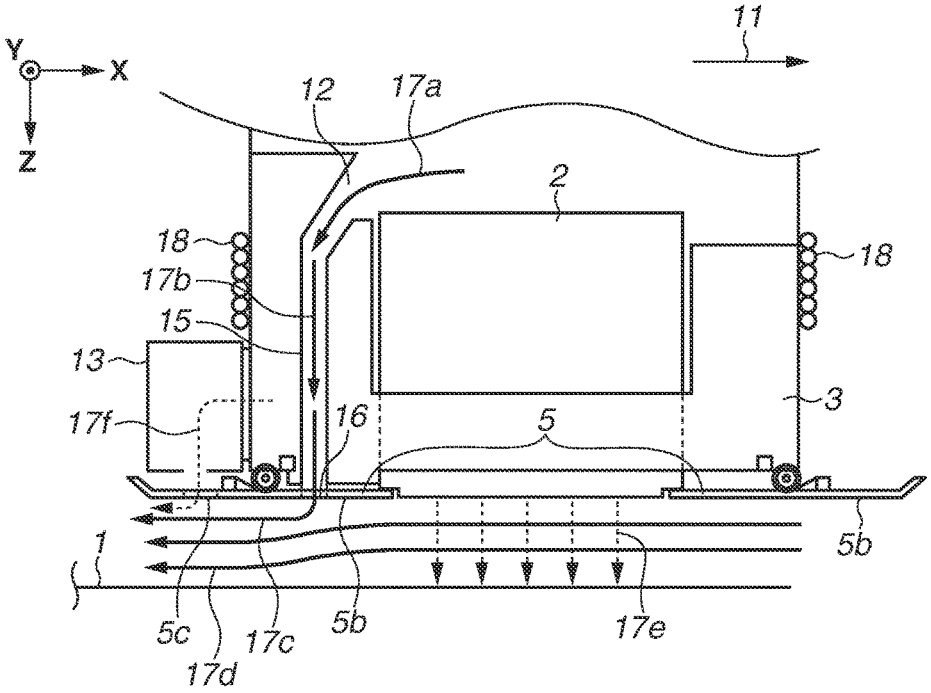
FIG. 5 is a front sectional view illustrating air current flows.

Air current flows in the periphery of the rectifying skirts 5 will be described below with reference to FIG. 5. FIG. 5 is a front sectional view illustrating air current flows around the rectifying skirt 5. FIG. 5 illustrates a state where the carriage 3 is moving in the direction (predetermined direction) indicated by an arrow 11.

An air inlet 12 is provided at the upper portion of the carriage 3. When the carriage 3 moves in the direction indicated by the arrow 11, air 17*a* naturally flows into the carriage 3 from the air inlet 12. The air inlet 12 communicates with a duct 15 in the carriage 3. The duct 15 is connected to the upper surface of the rectifying skirt 5. The duct 15 may not necessarily be provided as an airtight flow path. Essentially, it is necessary that a space exists in the carriage 3 so that the air that has flowed into the carriage 3 from the air inlet 12 flows downward toward the rectifying skirt 5.

The rectifying skirt 5 on the side of the sensor unit 13, out of the two rectifying skirts 5, is provided with a plurality of through holes 16 at predetermined positions facing the duct 15. The rectifying skirt 5 on the side with no sensor unit is not provided with through holes since they are not necessary.

When the carriage 3 runs in the direction indicated by the arrow 11, the air that naturally has flowed into the carriage 3 from the air inlet 12 with the running of the carriage 3 flows along the duct 15 by the influence of inflow, and reaches above the rectifying skirt 5. Then, air passes through the through holes 16 and is discharged downward toward the sheet 1.

The air inlet 12 is sufficiently separated from the nozzles on the print head 2 serving as a mist generation source by shielding members such as the print head 2 and the carriage structure. Fresh air 17*a* containing little ink mist on the upstream side of the running carriage 3 is taken in by the air inlet 12. Therefore, fresh air 17*b* passes through the duct 15 and is discharged downward from the through holes 16.

On the other hand, a polluted air current 17*d* containing ink mist, which occurred with ink discharge 17*e* from the nozzles of the print head 2, flows from the upstream of the through holes 16 to a space relatively under the sensor unit 13. As described above, the rectifying surface 5*a* and the nozzle surface 2*a* of the two rectifying skirts 5 are substantially integrally formed as one plane. Therefore, the air current 17*d* in the space between the sheet 1 and the carriage 3, as a whole, produces little turbulence.

The fresh air 17*b* supplied from the through holes flows downstream without being largely disturbed and then forms an air current 17*c* as a laminar flow with little turbulence. Specifically, air discharged from the through holes 16 becomes the air current 17*c* above the air current 17*d* polluted with mist and directly under the rectifying surface 5*a*. The air current 17*c* serves as a shield for making it hard that the polluted air current 17*d* under the air current 17*c* contacts the rectifying surface 5*a*, largely reducing the amount of ink mist adhering to the rectifying surface 5*b*. Openings 5*c* for sensing of the sensor unit 13 are formed on the downstream side of the through holes 16 of the rectifying surface 5*a*. The fresh air current 17*c* serves as a shield to prevent the polluted air current 17*d* from flowing into the sensor unit 13 from the openings 5*c*. Providing the through holes 16 on the rectifying skirt 5 in this way enables largely restraining the amount of ink mist adhering to the rectifying surface 5*b* and the sensor unit 13.

When the carriage 3 runs in the direction opposite to the direction indicated by the arrow 11 illustrated in FIG. 5, there arises no problem of mist stain on a sensor unit since no sensor unit is provided on the downstream side of the running carriage 3. When intentionally reducing mist stain on the rectifying surface 5*b* of the rectifying skirt 5 on the side with no sensor unit, it is necessary to provide a duct having an air inlet and to form through holes in the rectifying skirt 5 also on the side with no sensor unit. Although, in this example, the through holes 16 are formed separately from the openings 5*c* through which the optical axes of the sensor unit 13 pass, the openings 5*c* may also serve as the through holes 16.

Referring to FIG. 5, an air current 17*f* also occurs in the sensor unit 13. The air current 17*f* will be described in detail below.

Figure 6A:
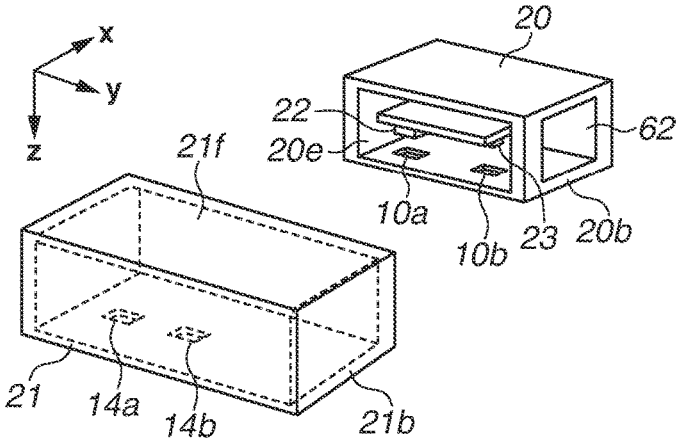
FIGS. 6A, 6B, and 6C illustrate a configuration of a sensor unit.
Figure 6B:
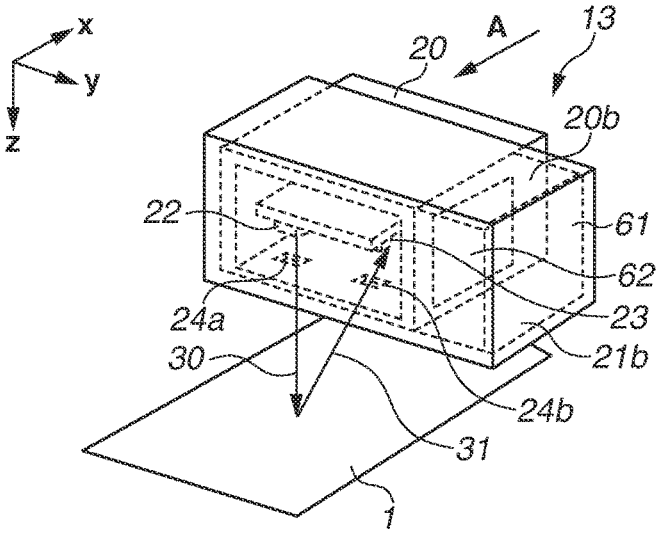
Figure 6C:
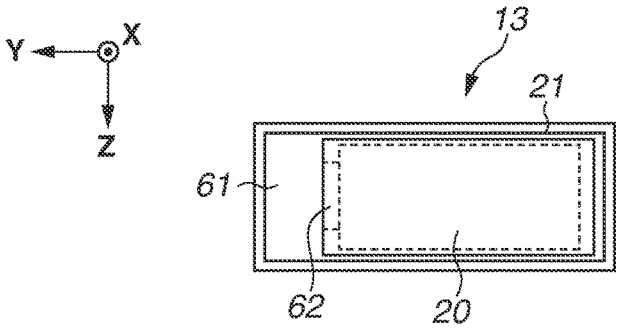

The configuration of the sensor unit 13 will be described below. FIGS. 6A to 6C illustrate the configuration of the sensor unit 13 illustrated in FIG. 2. FIG. 6A illustrates the components of the sensor unit 13 before assembly, and FIG. 6B is a perspective view illustrating the assembled sensor unit 13. FIG. 6C is a perspective view illustrating the sensor unit 13 when viewed from the direction indicated by the arrow A illustrated in FIG. 6B. FIGS. 6A and 6B illustrate the inside of a cover member 21.

As illustrated in FIG. 6A, a base member 20 has an internal space for storing the light emitting element 22 and the light receiving element 23 serving as sensor components. The base member 20 is provided with through holes 10*a* and 10*b*. The through hole 10*a* is formed at a position facing the disposed position of the light emitting element 22 not to interrupt the light emitted from the light emitting element 22. The through hole 10*b* is formed at a position facing the disposed position of the light receiving element 23 not to interrupt the reflected light to be received by the receiving element 23.

The cover member 21 has an internal space for storing the base member 20. The cover member 21 is provided with through holes 14*a* and 14*b*. The through holes 14*a* and 14*b* are formed at respective positions facing the through holes 10*a* and 10*b* of the base member 20, when the cover member 21 and the base member 20 are combined.

The base member 20 has a shape of an approximated rectangular parallelepiped. Referring to FIGS. 6A to 6C, the upstream side in the Z direction is defined as the upside. A side face 20*b* of the base member 20 on the downstream side in the Y direction is provided with a communication hole 62. The cover member 21 also has a shape of an approximated rectangular parallelepiped. A face 21*f* of the cover member 21 is open as an entrance through which the base member 20 is inserted into the cover member 21. Since the internal size of the cover member 21 is larger than the external size of the base member 20, the base member 20 is partially stored within the cover member 21. When combining the base member 20 and the cover member 21, a face 20*e* that is an open face of the base member 20 faces the face 21*f* that is an open face of the cover member 21, and the base member 20 is inserted into the cover member 21.

As illustrated in FIG. 6B, the entire sensor housing of the sensor unit 13 is configured by the combination of two housing members, i.e., the base member 20 and the cover member 21. The base member 20 and the cover member 21 are combined so that a part of the base member 20 is covered by the cover member 21. When the through holes 10*a* and 14*a* overlap, a sensing hole 24*a* to be used as an optical path on the light emitting side is formed between the sensor and the outside. Likewise, when the through holes 10*b* and 14*b* overlap, a sensing hole 24*b* to be used as an optical path on the light receiving side is formed. The sensing holes 24*a* and 24*b* are through holes for sensing. In the case of an optical sensor, light passes through the sensing holes 24*a* and 24*b* without being interrupted. Light 30 emitted from the light emitting element 22 passes through the sensing hole 24*a* and is radiated onto the sheet 1, and light 31 scattered and reflected on the sheet 1 passes through the sensing hole 24*b* and is received by the light receiving element 23. Referring to FIG. 6B, the above-described rectifying skirts 5 are omitted.

A larger gap than other portions is provided between the side face 21*b* of the cover member 21 on the downstream side in the Y direction and the side face 20*b* of the base member 20 on the downstream side in the Y direction. This gap forms the air inlet 61 that is one of openings of the sensor housing when the cover member 21 and the base member 20 are combined. The internal space of the air inlet 61 communicates with the internal space of the base member 20 via the communication hole 62 to form one space. As a whole, the internal space of the sensor housing is formed. The area of the opening of the air inlet 61 is larger than the hole area of each of the two sensing holes 24*a* and 24*b* and is also larger than the total of the hole areas of the two sensing holes 24*a* and 24*b*.

When the carriage 3 moves in a certain direction, air taken in from the air inlet 61 flows in the sensor housing as the air current 17*f* (refer to FIG. 5), restricting the amount of ink mist adhering to the light emitting element 22 and the light receiving element 23. More specifically, when the carriage 3 moves in the forward direction, air is actively taken in from the air inlet 61 (first opening) by using the movement of the carriage 3. The air taken in passes through the communication hole 62 and the internal space of the sensor housing, and flows out from the sensing holes 24*a* and 24*b* (second openings). This active air current generation using the scan movement of the carriage 3 will be described in detail below.

Figure 7:
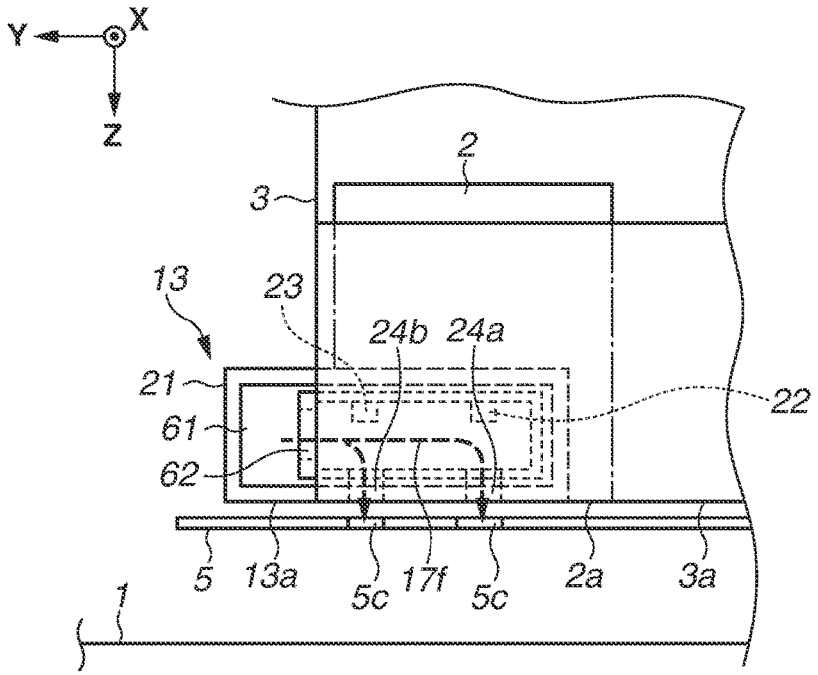
FIG. 7 illustrates a right-hand side of the carriage in a state where the sensor unit is attached to the carriage.

The configuration of a periphery of the sensor unit 13 will be described below with reference to FIG. 7. FIG. 7 is a right-hand side view illustrating the carriage 3 in a state where the sensor unit 13 is attached to the carriage 3. FIG. 7 illustrates the inside of the carriage 3, the sensor unit 13, the cover member 21, and the base member 20.

With a face 20*f* of the base member 20 in close contact with an attachment surface 3*e* (side face of the carriage 3 on the upstream side in the X direction), the sensor unit 13 is attached to the carriage 3. The sensor unit 13 is attached to the upstream side of the mounting position of the print head 2 on the carriage 3 in the X direction, i.e., the rear side in the X direction indicated by the arrow illustrated in FIG. 7. The undersurface of the sensor unit 13 (undersurface of the cover member 21), i.e., an outer surface on which the sensing holes 24*a* and 24*b* are formed, is provided right above the rectifying skirt 5.

The air inlet 61 of the sensor unit 13 opens toward the print head 2 in the X direction (toward the right-hand side illustrated in FIG. 5, toward the front side on paper illustrated in FIG. 7). As illustrated in FIG. 7, the air inlet 61 is disposed on the outer side of the cross-section of the carriage 3 on the YZ plane (cross-section of the carriage 3 on the YZ plane in the vicinity of the attachment portion of the sensor unit 13). When the carriage 3 is viewed from one direction in the moving direction of the carriage 3 (X direction), the sensor unit 13 is disposed so as to be posterior to the print head 2 (rear side on paper illustrated in FIG. 7) and at least a part of the air inlet 61 is exposed to the outside of the carriage 3 and the print head 2. The print head 2, the carriage 3, the sensor unit 13, and the air inlet 61 are positioned in this way. On the contrary, when the carriage 3 is viewed from the direction opposite to the above-described one direction, the sensor unit 13 is disposed so as to be anterior to the print head 2 and the carriage 3 (front side on paper illustrated in FIG. 7) and the air inlet 61 is not visible because the side facing the air inlet 61 is closed.

The air inlet 61 is disposed so as to protrude to the downstream side in the sheet conveyance direction (Y direction) from the vicinity of the sensor attachment portion of the carriage 3 and the nozzle surface 2*a* of the print head 2. The rectifying skirts 5 exist below these members. Since the downstream side in the sheet conveyance direction is subject to less floating ink mist than the upstream side, the air inlet 61 for air introduction is provided on the downstream side subjected to less ink mist. In addition, the rectifying skirt 5 below the air inlet 61 serves as a shield for preventing stirred up ink mist from being taken into the air inlet 61.

In this configuration, when the carriage 3 moves in the forward direction (direction toward the right-hand side illustrated in FIG. 5, direction toward the front side on paper illustrated in FIG. 7), wind relatively produced by the movement of the carriage 3 directly blows into the opening of the air inlet 61 without being disturbed by the carriage 3 itself. Specifically, when the carriage 3 moves toward the front side (forward direction) when viewed from one direction, air is taken into the sensor unit 13 from the air inlet 61 and discharged from the sensing holes 24*a* and 24*b* of the sensor unit 13, i.e., the air current 17*f* arises. A part of the discharged air passes through the openings 5*c* of the rectifying skirt 5 and advances to the sheet 1, and the remaining air is discharged to the gap between the upper surface of the rectifying skirt 5 and the undersurface of the housing of the sensor unit 13. At the same time, as described above, air is taken into the duct 15 also from the air inlet 12 and discharged downward from the openings 5*c* of the rectifying skirt 5 as the air current 17*c*. The double shield effect by the air currents 17*c* and 17*f* prevents the polluted air containing much ink mist from entering the sensor unit 13 from the sensing holes 24*a* and 24*b* thereof, largely restricting the amount of ink mist adhering to sensor components.

The sensor unit 13 may be attached to the carriage 3 on the opposite side in the carriage moving direction or may be attached thereto on both sides. Also in this case, the air inlet 61 of each sensor unit 13 opens on the side toward the print head 2 in the carriage moving direction.

The sensor unit 13 may be a sensor (for example, an ultrasonic sensor and an infrared sensor) using non-optical sensor components of which the performance degrades by the adhesion of ink mist. Also in this case, since sensing holes are required on the undersurface of the sensor housing, the action for discharging air inside the sensor unit 13 downward from the holes of the sensor housing is effective for preventing sensor components from being stained.

According to the above-described exemplary embodiment, by using the movement of the carriage 3, clean air containing little ink mist is supplied to under the rectifying skirt 5 and, at the same time, is also supplied in the sensor housing. This prevents polluted air containing much ink mist from entering the sensor housing, making it hard that ink mist adheres to the components of the sensor unit 13. As a result, a high detection accuracy of the sensor is maintained over a prolonged period of time. Since the adhesion of ink mist to the undersurface of the rectifying skirt 5 is also restrained, maintenance operations (cleaning) for the rectifying skirt 5 is not necessary over a prolonged period of time.

According to the present exemplary embodiment, the rectifying surface 5*b* extends over a wide range from the vicinity of the nozzle of the print head 2 to the outside of the carriage 3. A small amount of turbulence occurs, and a high rectification effect can be obtained. A plurality of the grooves 5*d* formed on the rectifying surface 5*b* provides a high rectification effect. In addition, even if mist adhering to the rectifying surface 5*b* becomes liquid, the liquid spreads along the grooves 5*d* and is retained by the large surface tension, making it hard that ink droplets drop from the rectifying surface 5*b*.

<Another Exemplary Embodiment>

Figure 9A:
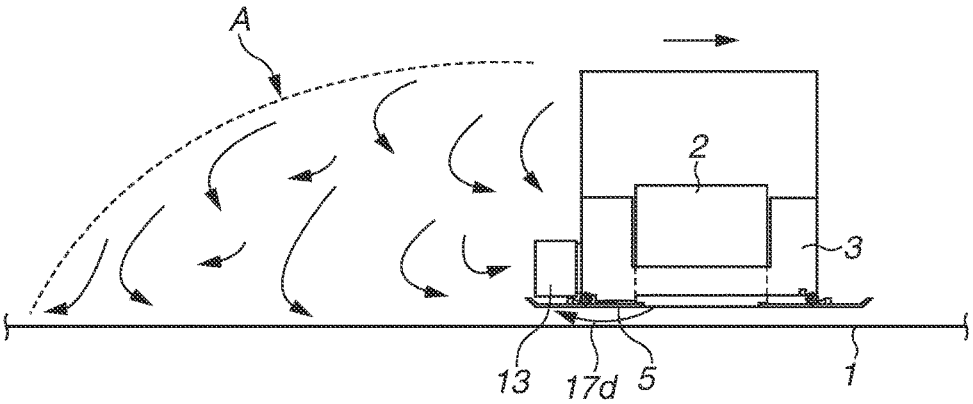
FIGS. 9A and 9B illustrate actions and effects according to the exemplary embodiment illustrated in FIG. 8.

Another exemplary embodiment will be described below. When the carriage 3 moves, a large curled air current called a wake occurs on the downstream side of the running carriage 3. FIG. 9A illustrates the generation of a wake. Referring to FIG. 9A, when the carriage 3 runs rightward, a low pressure occurring on the trailing side of the carriage 3 causes a curled air current. As a result, a wake A as turbulence occurs which contains whirlpools of various sizes as drawn by arrows. An air current containing ink mist which has occurred between the print head 2 and the sheet 1 is disturbed by the wake A below the sensor unit 13, and may adhere to the rectifying surfaces 5*b* of the rectifying skirts 5 and the sensor unit 13. This phenomenon is likely to occur when the movement of the carriage 3 is reversed from one direction to the opposite direction.

The present exemplary embodiment aims at restraining this phenomenon. According to the basic concept of the present exemplary embodiment, when the carriage 3 runs, the occurrence of a wake is weakened by discharging an air current from the upper portion of the sensor unit 13 downward.

Figure 8:
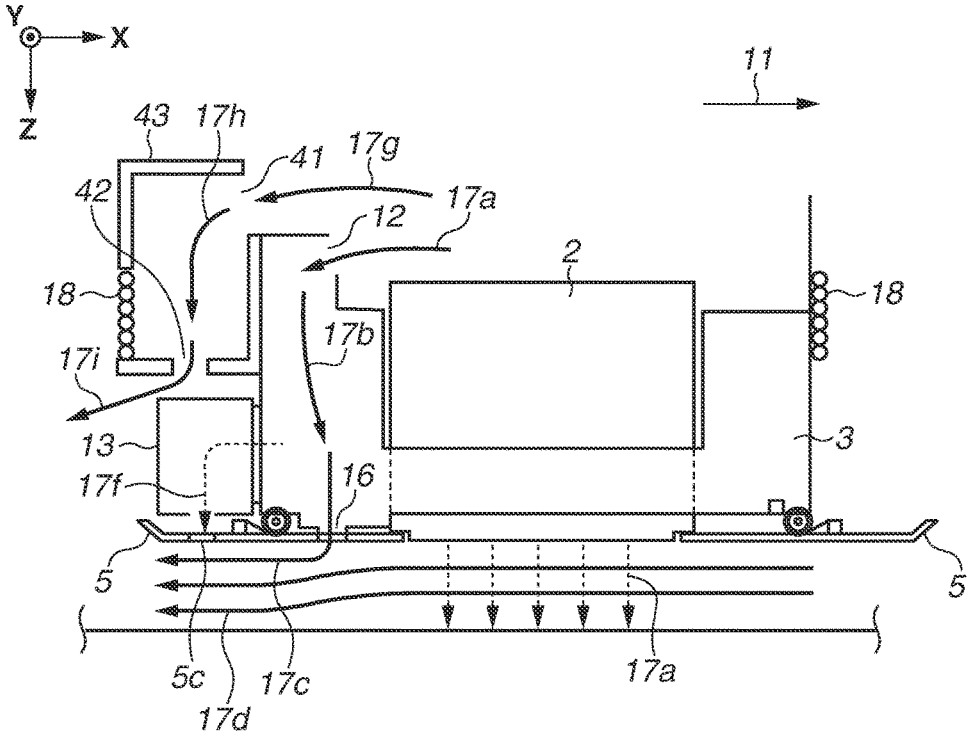
FIG. 8 is a front sectional view illustrating a configuration and air current flows according to another exemplary embodiment.

An exemplary embodiment for implementing this concept will be described below with reference to FIG. 8. FIG. 8 illustrates an apparatus configuration and air current flows. The basic configuration of the present exemplary embodiment is similar to that of the above-described exemplary embodiment. Identical or equivalent members are assigned the same reference numeral and duplicated descriptions thereof will be omitted.

The present exemplary embodiment is characterized in that a duct 43 for weakening a wake is provided at the upper portion of the sensor unit 13. The duct 43 is provided with an air inlet 41 at the top portion and an air outlet 42 at the bottom. When the carriage 3 runs in the direction indicated by the arrow 11, clean air containing little mist flows in from the air inlet 41. Then, the air flows in a space in the duct 43 as an air current 17*h* and escapes downward from the air outlet 42 as an air current 17*i*. In this example, the air current 17*i* is discharged from the air outlet 42 toward the top portion of the sensor unit 13. This air current flow is based on the same principle as the above-described one for taking in air from the air inlet 12 to produce the air current 17*b*.

Although, in this example, a flat bundle of the ink tubes 18 is used as a part of the wall surface of the duct 43, a flexible flat cable (FFC) may be used as a part of the wall surface in a similar way. Further, the duct 43 may be configured by the housing of the carriage 3 or a dedicated duct housing. Similar to the duct 15, the duct 43 may not necessarily be provided as an airtight flow path. It is essential that there is a space for producing the air current 17*h* in such a way that at least a part of the air that has flowed in from the air inlet 41 escapes downward from the air outlet 42 as the air current 17*i*.

Figure 9B:
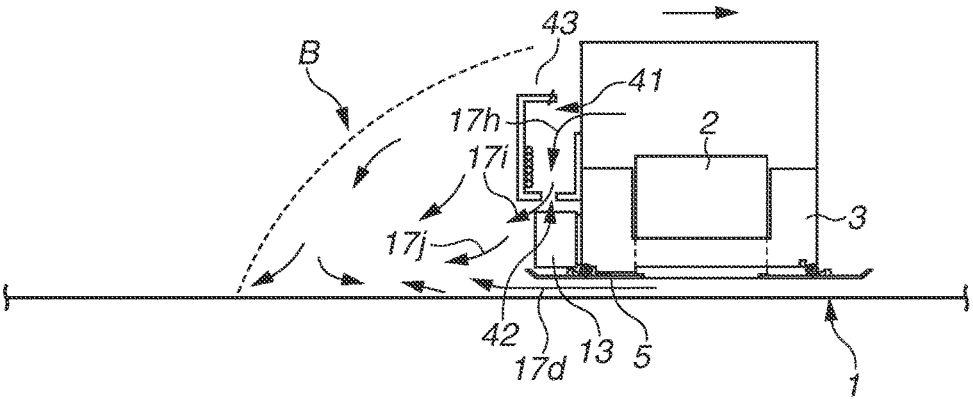

FIG. 9B illustrates the occurrence of a wake according to the present exemplary embodiment. The air current 17*i* passes through the duct 43 and is discharged downward from the air outlet 42. Since the carriage 3 escapes, the air current 17*i* flows downward aslant to the surface of the sheet 1 as an air current 17*j*. Then, the air current 17*i* joins together with the air current 17*d* that has flowed from under the print head 2. This joining takes place on the downstream side which is rather distant from the carriage 3.

The air currents 17*i* and 17*j* that has blown out downward from the air outlet 42 restricts the curling of an air current in this way, reducing the occurrence of a wake compared with the case illustrated in FIG. 9A. Therefore, the polluted air current 17*d* containing much ink mist that has flowed from under the print head 2 is restrained. As a result, the mist adhesion to the rectifying surface 5*b* of the rectifying skirt 5 and the sensor unit 13 is effectively restrained.

In the present exemplary embodiment, the air inlet 41 for taking in air when the carriage 3 moves in a predetermined direction is formed, and the air taken in therefrom passes through the duct 43 and escapes downward from the air outlet 42 toward the upper portion of the sensor unit 13. This restricts the occurrence of a wake to prevent mist stain of the rectifying skirts 5 and the sensor unit 13.

Further, the present exemplary embodiment has a similar configuration to that of the above-described exemplary embodiment, and actions and effects by the configuration can be acquired. As a result, the present exemplary embodiment provides excellent actions and effects. More specifically, a high detection accuracy of the sensor is maintained over a prolonged period of time, the frequency of cleaning the rectifying skirts 5 can be reduced, making it hard that ink droplets drop from the rectifying surfaces 5*b*.

While aspects of the present invention have been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-189036, filed Sep. 26, 2015, which is hereby incorporated by reference herein in its entirety.

What is claimed is:

1. An inkjet apparatus comprising:

a carriage configured to move with a recording head mounted thereon, the recording head having a discharge port surface on which a plurality of discharge ports is provided;

a platen configured to support a sheet at a position facing the recording head;

a rectifying skirt provided at at least one of front and rear of the carriage in a moving direction of the carriage, and having a rectifying surface at a side facing the platen; and a sensor attached to the carriage and configured to read information on the sheet supported by the platen, the sensor being provided at an opposite side away from the platen with respect to the rectifying skirt, and the sensor reading the information on the sheet through a hole formed in the rectifying skirt.

2. The inkjet apparatus according to claim 1, wherein the sensor has an air inlet and sensing holes, and wherein, when the carriage moves, an air current arises in the sensor which is taken in from the air inlet and escapes from the sensing holes.

3. The inkjet apparatus according to claim 1, wherein the rectifying skirt is provided at both the front and rear of the carriage in the moving direction of the carriage; and wherein the sensor is provided at the opposite side away from the platen with respect to the rectifying skirt of either one.

4. The inkjet apparatus according to claim 1, wherein a nozzle surface of the recording head and the rectifying surface is at approximately the same height from the sheet.

5. The inkjet apparatus according to claim 1, wherein an end of the rectifying skirt contacts an abutting portion of the recording head, and wherein the rectifying surface extends from under the abutting portion to an outside of the carriage in a direction of the movement.

6. The inkjet apparatus according to claim 5, wherein the rectifying skirt is supported by the carriage so that an orientation of the rectifying skirt is allowed to slightly change in a state where the recording head is not mounted on the carriage.

7. The inkjet apparatus according to claim 1, wherein the rectifying surface has grooves formed thereon each extending in a direction intersecting with a nozzle array of the recording head.

8. An inkjet apparatus comprising:

a carriage, mounting a head that discharges ink, configured to reciprocally move with respect to a sheet;

a sensor unit, attached to the carriage, and configured to read information from the sheet; and a rectifying skirt, attached to the carriage, having a rectifying surface that faces the sheet, wherein the rectifying skirt has a hole formed between the head and the sensor unit in a direction of the reciprocal movement.

9. The inkjet apparatus according to claim 8, further comprising an air inlet for taking in air when the carriage moves toward a predetermined one side in which the sensor unit is posterior to the head, and wherein the air taken in from the air inlet escapes partially from the hole toward the sheet.

10. The inkjet apparatus according to claim 9, wherein the sensor unit has an air inlet and sensing holes, and wherein, when the carriage moves toward the predetermined one side, an air current arises in the sensor unit which is taken in from the air inlet and escapes from the sensing holes.

* * * * *